United States Patent [19]

Barge

[11] 4,124,077

[45] Nov. 7, 1978

[54] SPRINKLER HEAD WITH WALL PENETRATING MEANS

[75] Inventor: Timothy T. Barge, Suitland, Md.

[73] Assignees: Thomas J. Masano, Suitland; John T. Masano, Brandywine, both of Md.; part interest to each

[21] Appl. No.: 797,342

[22] Filed: May 16, 1977

[51] Int. Cl.[2] ..... A62C 37/08

[52] U.S. Cl. ..... 169/70; 169/37; 239/271

[58] Field of Search ..... 169/37–42, 169/70, 90; 239/271

[56] References Cited

U.S. PATENT DOCUMENTS

| | | | |
|---|---|---|---|
| 1,106,679 | 8/1914 | Randall | 239/271 |
| 2,548,621 | 4/1951 | Rutledge | 239/271 |
| 3,714,989 | 2/1973 | Gloeckler | 169/42 X |
| 4,015,665 | 4/1977 | Simons et al. | 169/42 X |

FOREIGN PATENT DOCUMENTS

| | | | |
|---|---|---|---|
| 2,646,574 | 5/1977 | Fed. Rep. of Germany | 169/41 |

*Primary Examiner*—Robert W. Saifer
*Attorney, Agent, or Firm*—Finnegan, Henderson, Farabow and Garrett

[57] ABSTRACT

A sprinkler head for use in residential areas, or the like, requiring the maintenance of aesthetic appearance, including a bayonet impacted by a spring-biased power sleeve for penetrating an interior ceiling or wall. The power sleeve is restrained in the ready position by a wire cable having a rupturable portion separable by heat or other means controlled by a remote device for sensing an incendiary condition in the space to be fire-protected on the opposite side of the ceiling or wall from the sprinkler head.

12 Claims, 3 Drawing Figures

Fig. 1
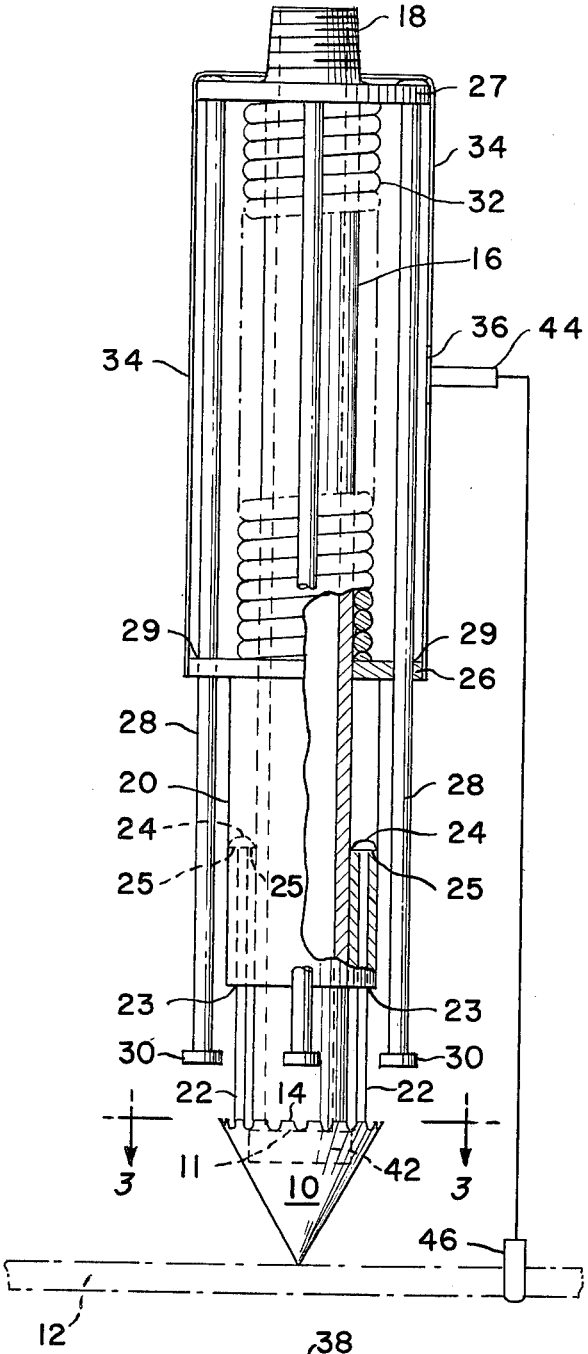
Fig. 2
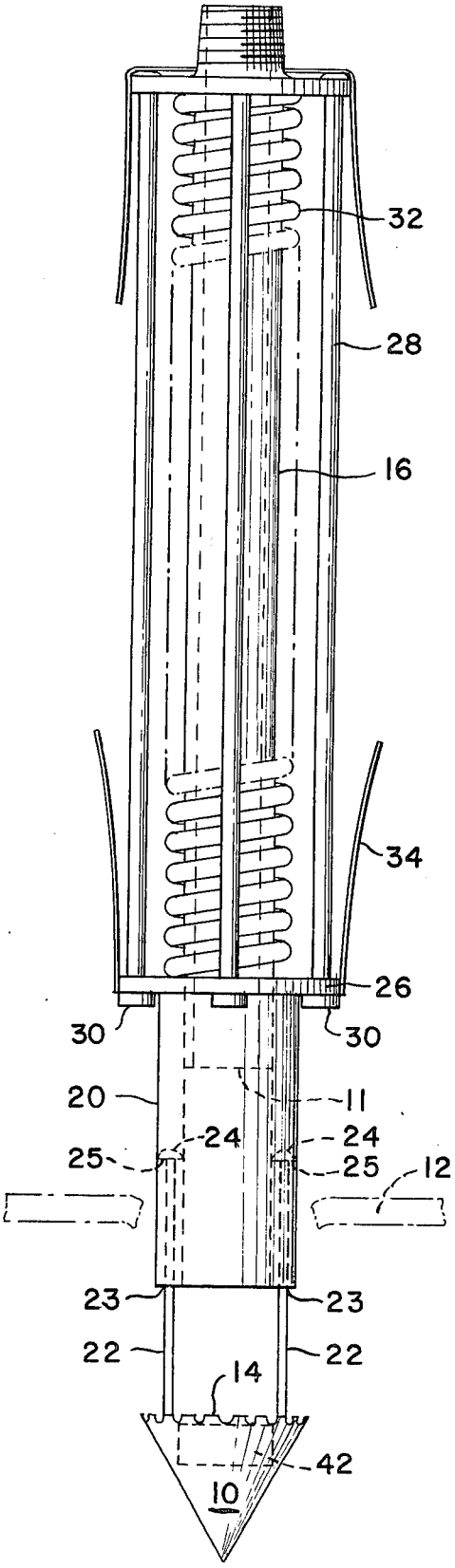
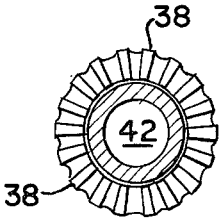
Fig. 3

SPRINKLER HEAD WITH WALL PENETRATING MEANS

BACKGROUND OF THE INVENTION

1. Field of the Invention

This invention relates to fire suppression sprinkler systems and more particularly to a sprinkler head screened from the area to be protected and having means for penetrating the screen and dispersing fire-extinguishing fluid into the protected area.

2. Description of the Prior Art

It has long been known to suppress fires by sprinkler systems. In fact, under many State laws such systems are required for certain types of building occupancy. Such systems are not ordinarily used, however, in residences and other types of buildings in which it is desirable to protect the aesthetics of the occupied areas. Some efforts have been made to provide inconspicuous sprinkler heads to be incorporated in the walls of such areas but to date it has been necessary that the sprinkler heads be physically present in the areas to be protected. Such devices interfere with the general appearance and aesthetics of the wall spaces enclosing areas where appearance is important. Those reasons contribute to the fact that sprinkler systems are not often found in personal residences.

It is, therefore, the object of this invention to provide a sprinkler head which is to be screened from the areas to be protected from fire, being, for example, above the ceiling of the space to be protected.

SUMMARY OF THE INVENTION

The object of the invention, and other objects which will become obvious from the study of the description and the claims, are achieved by a sprinkler head including a supply tube for conveying a fire-extinguishing fluid, means for penetrating a screen for dispersion of the fluid from the tube into the area beyond the screen to be protected, means for impacting against the penetrating means and means for restraining the impacting means in the ready position of the sprinkler head, the restraining means including a portion that is rupturable on command.

Preferably the penetrating means includes bayonet means having a base portion for blocking the discharge end of the tube in the ready position of the head, and the impact means includes a sleeve slidably mounted on the tube and a coil spring coaxial with the tube.

Preferably also the sprinkler head includes a base plate fixed near the supply end of the tube and the sleeve includes a flange, the restraining means including cable means for tensioning the coil spring between the base plate and the flange.

The invention also includes a sprinkler head system including the sprinkler head of the invention, means for sensing an incendiary condition in the area to be fire-protected and means responsive to the sensing means for rupturing the rupturable portion of the restraining means.

BRIEF DESCRIPTION OF THE DRAWINGS

The accompanying drawings, which are incorporated in and constitute a part of this Specification, illustrate the preferred embodiment of the invention and, together with the description, serve to explain the principles of the invention.

FIG. 1 is a front view of the sprinkler head of the invention in the ready position;

FIG. 2 is a partial front view of the sprinkler head of FIG. 1 in the actuated position; and FIG. 3 is a cross-sectional view taken along the lines 3—3 of the sprinkler head of FIG. 1, showing the base of the bayonet.

DESCRIPTION OF THE PREFERRED EMBODIMENT

The sprinkler head of the invention utilizes means for penetrating the enclosure of a space to be protected against fire, the enclosure of which may be a wall or ceiling of the enclosure or other type of screen.

As shown in the embodiment of FIG. 1, the penetrating means includes a bayonet 10 which preferably is conical in configuration and may be formed of metal or plastic.

In the ready position of the sprinkler head the base 14 of the bayonet 10 plugs the discharge end of the fire-extinguishing fluid supply tube 16 which extends substantially through the sprinkler head. The tube 16 terminates at its supply end in a threaded portion 18 for connection to a supply of fire-extinguishing fluid.

The invention also includes means for impacting against the penetrating means. As embodied herein, the impacting means includes a sleeve 20 coaxial with the supply tube 16 and slidably mounted thereon and having substantially the same diameter as the base 14 of the bayonet 10, and force means for driving the sleeve against the penetrating means.

Attached to the base 14 of the bayonet 10 and spaced around its periphery is a plurality of guide rods 22 extending into apertures 23 in the impact sleeve 20. Each of the guide rods 22 terminates in an enlarged portion or button 24 which interacts with shoulders 25 in the sleeve 20 to limit the axial motion of the bayonet 10 as to the sleeve 20.

In the ready position of the sprinkler head with the base 14 of the bayonet 10 fixed against the discharge end 11 of the supply tube 16 approximately one-half of the length of the guide bars 22 is contained within the sleeve 20. There is axial movement of the bayonet 10 with respect to the sleeve 20 for purposes to be explained hereinafter.

The impact sleeve 20 includes flange 26 mounted on the end of the sleeve parallel to, and opposite the bayonet 10.

The flange 26 includes a plurality of apertures 29 spaced around its periphery by means of which the sleeve 20 is slidably mounted on elongated guide bars 28 each having one end fixed in the base plate 27 of the sprinkler head adjacent the threaded portion 18 of the supply tube and having the other end extending to a position preferably intermediate the impact end of the sleeve 20 in the ready position and the base 14 of the bayonet 10. The elongated guide rods 28 terminate at their unattached ends in abutments 30 which limit the travel of the impact sleeve 20 toward the wall 12.

The force means of the impacting means of the invention includes a coil spring 32 encircling the supply tube 16 and having its ends captured between the flange 26 and the base plate 27 of the sprinkler head. In the ready position of the sprinkler head the flange 26 compresses the spring 32 against the base plate 27.

In the ready position of the sprinkler head, the buttons 24 on the ends of the guide rods 22 are flush against the shoulders 25 in the impact sleeve 20 and the pressure on the flange 26 of the sleeve to compress the spring 32 also impresses the base 14 of the bayonet 10 against the discharge end 11 of the supply tube 16.

The base 14 of the bayonet 10 includes an insert 42 of slightly larger diameter than the discharge end of the supply tube 16. The insert preferably is made of pliable material such as neoprene. When the sprinkler head is being prepared in the ready position, the bayonet 10 is forced against the discharge end 11 of the tube 16, impressing the tube into the insert 42. Preferably the tube is pressed into the insert for a distance of about 0.0625 in. which is sufficient to block water flow from the tube.

The invention includes means for restraining the impacting means in the ready position of the sprinkler head, the restraining means including a portion rupturable on command. As embodied herein, the restraining means include a wire cable 34 holding the flange 26 against the bias of the spring 32, the cable suitably extending around both the flange 26 and the base plate 27.

The cable 34 includes a rupturable portion, preferably a separable solder link 36, which, upon rupture, releases the flange 26 to the force of the spring 32. The sleeve 20, through the action of the spring 32 on the flange 26, is driven along the guide rods 28 and impacts against the base of the bayonet 10. The sleeve 20 and the bayonet 10 are driven together by the spring 32 until the flange 26 impacts against the abutments 30 of the guide rods 28.

By the first impact of the sleeve 20 against the base 14 of the bayonet 10, the discharge end 11 of the supply tube 16 is freed from the insert 42 in the base of the bayonet, releasing the supply of fire-extinguishing fluid, preferably water. The guide rods 22 are then free to slide out outwardly until the button ends 24 on the ends of the guide rods again interact with the shoulders 25 in the sleeve 20.

By the force of the release of the spring 32 the bayonet 10 is driven through the wall 12, rupturing the wall. It has been found that a spring constant K of 995.2 lbs/ft is required for the spring 32 to penetrate gypsum board and 632.0 lbs/ft to penetrate ceiling tile.

It is obvious that force means other than a coil spring may be utilized, such as explosive powder, a carbon dioxide cartridge or high water pressure. The coil spring is preferred, however, being simple, inexpensive, reliable in all temperatures and relatively quiet in operation.

As shown in FIG. 2 in the actuated position of the sprinkler head it is preferred that the sprinkler head be positioned so that the impact end of the sleeve 20 extends through the wall 12 to be penetrated. The length of the guide rods 22 extending outside the sleeve 20 is such that, when the bayonet 10 is driven through the wall 12, the inertia and water force will carry the bayonet well beyond the penetrated wall. Although the guide rods 22 may be forced back into the sleeve 20 as the bayonet 10 is driven through the wall 12, they immediately are again forced outwardly to the limit of their axial movement as determined by the shoulders 25 in the sleeve 20.

As shown in FIG. 3 the base of the bayonet 10 is formed with a plurality of radial lug members 38 spaced about its periphery for deflecting water circumferentially outwardly from the sprinkler head. The lugs 38 surround the insert 42 which acts against the discharge end of the supply tube 16 in the ready position of the sprinkler head, as stated above.

The sprinkler head system of the invention also includes means for sensing an incendiary condition in the area to be fire-protected and means responsive to the sensing means for rupturing the rupturable portion of the restraining means.

The rupturing means, as embodied herein, may include any known device 44, such as a heating or explosive device, for rupturing the rupturable portion 36 of the restraining means.

Likewise, the sensing means may include any known sensing device 46 mounted in the wall 12, or anywhere in the space to be protected, for recognizing any incendiary situation in the space enclosed by the wall. Such a sensing device may be activated by heat or smoke as known in the art. A signal provided by the sensing device 46 can then actuate the rupturing device 44 for melting or otherwise rupturing the separable link 36.

The sprinkler head of the invention can penetrate various types of interior wall structural members such as wall board, plaster, etc. The strength of the spring 32 may be matched with the resistance of the material in the wall 12. It is apparent that the spring should be of excellent quality and preferably should be stress relieved by heating to prevent a permanent set of the spring during relatively long periods of stress in the ready position of the sprinkler head.

Various elements of the invention may be formed of metal or various plastics, as suitable. The sprinkler head may incorporate any size supply tube or penetrating head as required. In residential room environments, for example, the discharge end of the supply tube need only be 0.146 in. in diameter delivering 4.92 gallons of water per minute at 92 psig.

The bayonet 10 may, of course, be of shapes other than conical. The conical shape is preferred, however, the cone having a cross-section in the form of an equilateral triangle.

What is claimed is:

1. A sprinkler head for positioning on the opposite side of a penetrable screen from the area to be fire-protected comprising:

a supply tube for conveying a fire-extinguishing fluid;

means for penetrating and rupturing the screen for dispersion of the fluid from the tube into the area to be protected;

means for impacting against said penetrating means; and means for restraining said impacting means in ready position of the sprinkler head, said restraining means including a portion rupturable on command.

2. The sprinkler head of claim 1 wherein said screen is an interior wall or ceiling structure and said penetrating means includes bayonet means.

3. The sprinkler head of claim 2 wherein said supply tube includes a supply end and a discharge end and wherein said bayonet means includes a base portion for blocking the discharge end of the tube in the ready position of the head.

4. The sprinkler head of claim 3 wherein said impacting means includes a sleeve coaxial with said tube and force means for driving said sleeve against said penetrating means.

5. The sprinkler head of claim 4 wherein said force means is a coil spring coaxial with said tube.

6. The sprinkler head of claim 5 also including a fixed base plate adjacent said supply end of said tube and wherein said sleeve includes a flange remote from said bayonet, said sleeve being slidably mounted on said tube and said restraining means includes cable means for tensioning said coil spring between said base plate and said flange.

7. The sprinkler head of claim 6 also including a plurality of elongated guide rods spaced about and affixed at one end to the base plate, the other ends being unattached, and wherein said flange includes a like plurality of apertures for slidably mounting said sleeve on said elongated rods, said elongated guide rods including abutment means at their unattached ends for limiting the excursion of said sleeve under the force of said coil spring.

8. The sprinkler head of claim 3 wherein said base portion of said bayonet includes an insert, said discharge end of said tube being force-fitted into said insert in the ready position of the sprinkler head.

9. The sprinkler head of claim 8 wherein said bayonet is conical and said base portion is circular, the periphery of said base portion surrounding said insert being formed in a plurality of spaced radial lugs for deflecting the fire-extinguishing fluid.

10. The sprinkler head of claim 9 wherein said penetrating means also includes a plurality of guide rods fixed to and spaced about the periphery of said base portion of said bayonet, said guide rods being slidably mounted in the body of said sleeve for limited movement therein to permit release of said discharge end of said tube from the force-fit with said insert.

11. The sprinkler head of claim 10 wherein said insert is composed of neoprene.

12. A sprinkler head system for positioning a sprinkler head on the opposite side of a penetrable screen from the area to be fire-protected, comprising:

a supply tube for conveying a fire-extinguishing fluid;

means for penetrating and rupturing the screen for dispersion of the fluid from the tube into the area to be protected;

means for impacting against said penetrating means;

means for restraining said impacting means in the ready position of the sprinkler head, said restraining means including a portion rupturable on command;

means for sensing an incendiary condition in the area to be fire-protected; and means responsive to said sensing means for rupturing said rupturable portion of said restraining means.

* * * * *